United States Patent [19]

Gunness

[11] Patent Number: 5,020,630

[45] Date of Patent: Jun. 4, 1991

[54] LOUDSPEAKER AND HORN THEREFOR

[75] Inventor: David W. Gunness, Buchanan, Mich.

[73] Assignee: Electro-Voice, Inc., Buchanan, Mich.

[21] Appl. No.: 447,608

[22] Filed: Dec. 8, 1989

[51] Int. Cl.[5] ..... G10K 11/00

[52] U.S. Cl. ..... 181/192; 181/187; 181/195; 381/156

[58] Field of Search ..... 181/185, 187, 192, 195; 381/156

[56] References Cited

U.S. PATENT DOCUMENTS 4,187,926 2/1980 Henricksen et al. ..... 181/187 X
4,324,313 4/1982 Nakagawa ..... 181/192
4,580,655 4/1986 Keele, Jr. ..... 181/192
4,685,532 8/1987 Gunness ..... 181/185

*Primary Examiner*—Benjamin R. Fuller
*Attorney, Agent, or Firm*—Burmeister, York, Palmatier & Zummer

[57] ABSTRACT

A loudspeaker for projecting sound over a listening area having a driver and a horn in which the horn has a coupling portion communicating at an interface with an outwardly flaring portion, the horn forming an elongated slot at the interface and being provided with means for controlling the sound energy along the axis of elongation of the slot, namely a slot which is narrower at one end and flares outwardly to the other end, or a plurality of transverse veins dividing the slot and sound channel.

20 Claims, 4 Drawing Sheets

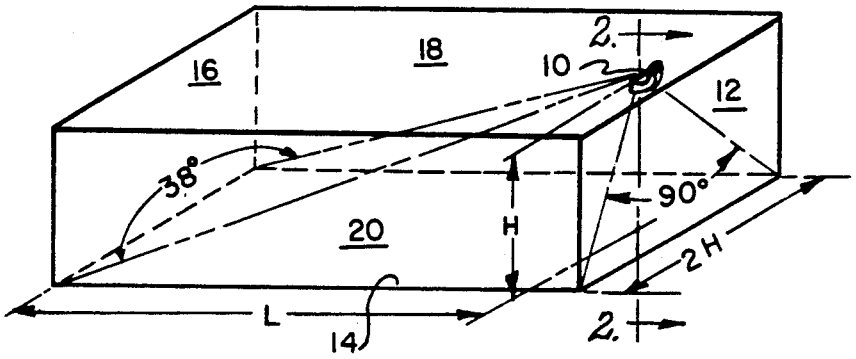
FIG. 1
FIG. 2
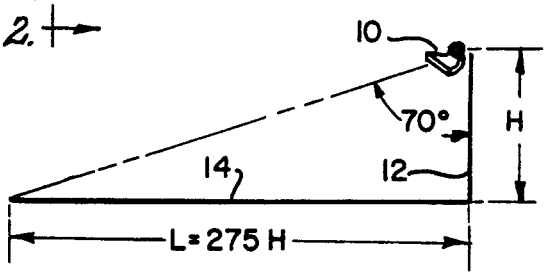
FIG. 3
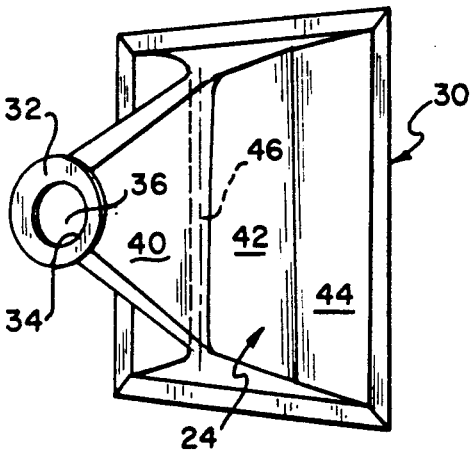
FIG. 5
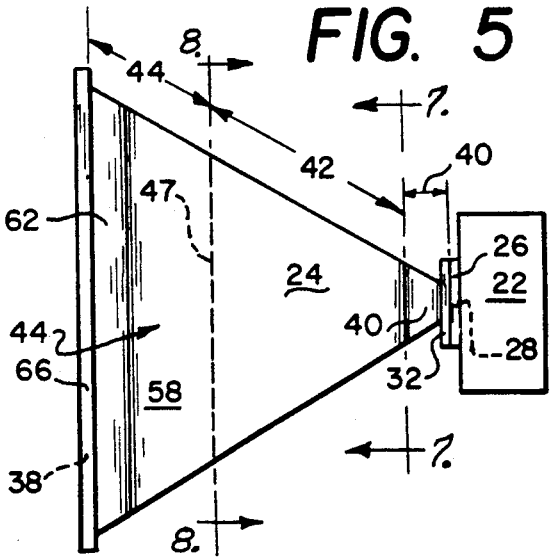
FIG. 4
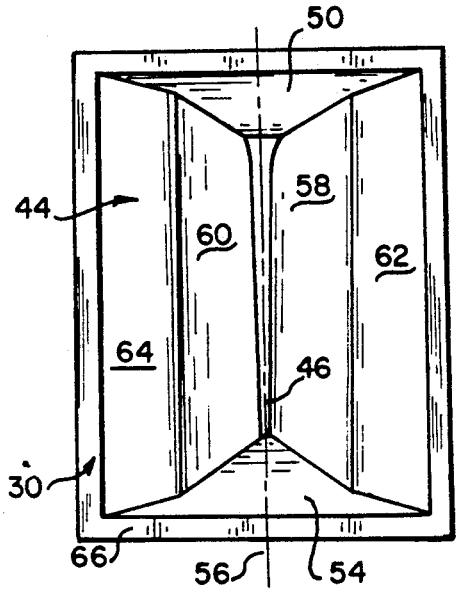
FIG. 6
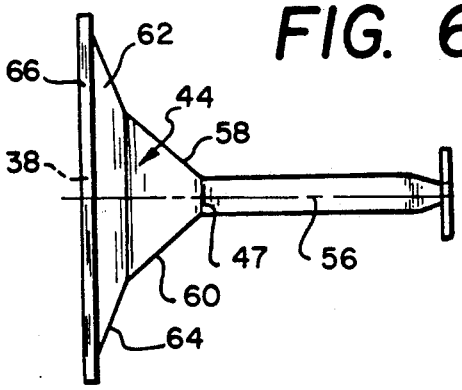

LOUDSPEAKER AND HORN THEREFOR

The present invention relates to horn-type loudspeakers and particularly to horn loudspeakers intended to project sound into a listening area such as a room, auditorium or outdoor amphitheater. The present invention also relates to horns for such loudspeakers.

BACKGROUND OF THE INVENTION

Sound engineers conventionally mount one or more horn-type loudspeakers above and at the perimeter of the area into which sound is to be provided or reinforced. A universal challenge in such a construction is to provide uniform sound pressure to all portions of the listening area, and often this challenge requires the use of a plurality of loudspeakers even though a single loudspeaker can supply the necessary acoustical power. The use of a plurality of loudspeakers is not only costly, but tends to degrade acoustical performance. Multiple sources of sound result in some locations within the listening area receiving sound from multiple paths, the sound waves from the different paths having undesirable phase differences which can severely degrade performance.

If the listening area is an enclosed auditorium, performance is also degraded by sound reflections from the walls of the auditorium. For this reason, it is necessary for sound engineers to position the loudspeakers used to provide sound to an enclosed auditorium to limit the sound intensity impinging upon the walls of the auditorium to low levels. Often this requirement can only be achieved by use of multiple horn-type loudspeakers even though only a single loudspeaker is required to produce the specified sound level.

It is an object of the present invention to provide a horn-type loudspeaker which may be positioned adjacent to and above a listening area and produces a sound intensity pattern at the listening area which is substantially constant. To achieve this object, a horn-type loudspeaker must produce a sound intensity pattern projecting much more sound energy to the listening areas remote from the loudspeaker than to listening areas adjacent to the loudspeaker.

It is also an object of the present invention to provide a horn-type loudspeaker which produces a sound intensity pattern over an area extending just beyond the border of the listening area, and in the application of this object to a rectangular auditorium, the object is to provide such a horn with a truncated sound intensity pattern. A horn thus constructed is desirable for use in an enclosed rectangular auditorium, since it can be mounted centrally on one end wall above the listening area, or two such horn loudspeakers can be mounted above and centrally of the listening area in back to back relation, the resulting sound pattern being substantially coincident with the listening area. In this manner, the level of projected sound impinging upon the walls of the auditorium is reduced significantly, and performance degrading sound reflections are reduced to low levels.

It is a further object of the present invention to provide a horn-type loudspeaker which simultaneously incorporates all of the foregoing objects. The inventor seeks to provide a horn-type loudspeaker which may be mounted centrally on one wall of a rectangular auditorium above the listening area and project a uniform sound pressure over the listening area limited at its perimeter to the walls of the auditorium.

For auditoriums which are longer than can be serviced by a single loudspeaker, or which require more acoustical energy than can be provided by a single horn-type loudspeaker, the present invention contemplates the use of two loudspeakers constructed according to the present invention mounted in back to back relation above the center of the auditorium. The auditorium can be considered to be two contiguous listening areas, and a single horn-type loudspeaker according to the present invention utilized for each of the listening areas.

It is also an object of the present invention to provide a loudspeaker with two horn structures directed in opposite directions in a single unit which functions in the manner of the two loudspeakers mounted in back to back relation referred to above.

There have been many attempts to control the sound wave propagation of horn-type loudspeakers. U.S. Pat. No. 2,537,141 to Paul W. Klipsch entitled Loud-Speaker Horn discloses a horn-type loudspeaker with controlled angular radiation in which the sound waves expand from the throat of the horn first in one plane and thereafter in the orthogonally related plane. U.S. Pat. No. 4,071,112 to D. Broadus Keele, Jr. entitled Horn Loudspeaker discloses a horn-type loudspeaker with a controlled sound pattern in which the expansion of the sound waves first occurs exponentially from the horn throat, and thereafter conically.

U.S. Pat. No. 4,308,932 to D. Broadus Keele, Jr. entitled Loudspeaker Horn discloses a horn-type loudspeaker for providing sound coverage to a rectangular listening area from an oblique angle, and Keele, Jr. further described his work in a paper entitled A LOUDSPEAKER HORN THAT COVERS A FLAT RECTANGULAR AREA FROM AN OBLIQUE ANGLE given before the Audio Engineering Society Convention, Oct. 8 through 12, 1983. The horn-type loudspeaker of the Keele, Jr. patent and paper varies the horizontal coverage as a function of elevation angle, but provides approximately the same sound energy for all elevational angles, and thus does not generally produce a uniform sound pressure over a rectangular listening area. Even though the remote portions of the listening area are served by sound waves propagated through narrow portions of the horn and the adjacent portions of the listening area are served by sound waves propagated through wider portions of the horn, the concentration of sound energy directed to these remote areas is insufficient to compensate for the loss in sound pressure due to the increase in distance to these remote areas from the horn.

DESCRIPTION OF THE INVENTION

The present invention provides a horn-type loudspeaker which provides uniform sound pressure over a listening area from a position located above and displaced from the center of the area. The loudspeaker has a driver which produces a uniform distribution of sound energy across its output port, and a horn coupled to the output port of the driver with an outwardly flaring portion for directing and distributing sound over the listening area. The horn is provided with means disposed between the inlet opening of the horn and the outwardly flaring portion for confining the sound transmitted to the outwardly flaring portion of the horn to a narrow elongated band and progressively increasing the sound energy in the band from one end of the band to the other end of the band.

More specifically, the horn has walls defining a sound path extending between the sound inlet opening and the mouth. The sound inlet opening of the horn is adapted to be acoustically coupled to the output port of the driver. The horn has a coupling portion extending from the inlet opening and an outwardly flaring portion for directing and distributing sound over the listening area extending from the coupling portion to the mouth. A slot is disposed across the sound path at the interface between the coupling section and the outwardly flaring section of the horn, and the slot has a substantially smaller cross section than the mouth of the horn. The slot has opposite ends and an axis of elongation extending between the ends thereof. The walls of the horn confine the sound path and provide a smooth transition between the inlet opening of the horn and the slot. The horn also has means for controlling the sound energy along the longitudinal axis of the slot so that the sound energy is lowest at one end of the slot and progressively increases to the other end of the slot.

In a preferred construction, the inlet orifice of the horn section is circular and the coupling portion of the horn has two intercoupled sections between the inlet orifice and the slot. The first section of the coupling portion has four flat walls extending from the slot and the second section extends between the first section and the inlet orifice. The second section forms a smooth acoustical transition for the sound path between the four flat walls and the circular inlet orifice.

Also in the preferred construction, the outwardly flaring portion of the horn is divided into two intercoupled sections. One of the sections extends from the coupling portion of the horn and is flared outwardly to control sound propagation to the shape of the intended listening area. The other section is a bell which flares outwardly at a rate exceeding the flare of the one section.

DESCRIPTION OF THE DRAWINGS

The invention will be more fully described with reference to the following drawings:

FIG. 1 is a diagramatic view of a rectangular area to be provided with a uniform sound pressure level;

FIG. 2 is a sectional view taken along the plane 2—2 of FIG. 1;

FIG. 3 is an isometric view of a loudspeaker horn constructed in accordance with the present invention;

FIG. 4 is a front elevational view of the loudspeaker horn of FIG. 3;

FIG. 5 is a side elevational view of a loudspeaker employing the horn of FIG. 3;

FIG. 6 is a plan view of the horn illustrated in FIGS. 3 through 5;

DETAILED DESCRIPTION OF THE INVENTION

Figure 7:
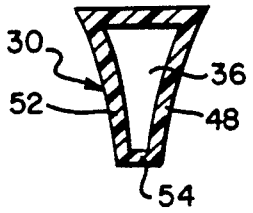
FIG. 7 is a sectional view taken along line 7—7 of FIG. 5.

The present invention is applicable to any geometrically shaped listening area, such as a circle, square, rectangle, truncated triangle or the like, but since most auditoriums are rectangular in shape, the invention will be described with reference to this application. FIGS. 1 and 2 illustrate the problem of tailoring the shape of the vertical and horizontal sound distributions of the loudspeaker to provide a uniform sound pressure level for all portions of the listening area of the auditorium. The loudspeaker 10 is mounted centrally on one end wall 12 of the auditorium at a distance H above the floor 14 of the auditorium. The auditorium has a second end wall 16 spaced from the first end wall 12. In the particular construction illustrated, the second end wall 16 is spaced from the first end wall 12 by a distance selected to be 2.75 times the distance H by which the loudspeaker is mounted above the floor 14. With this configuration, the vertical sound pattern of the loudspeaker must provide a sound distribution through an angle of 70 degrees, as indicated on FIG. 2, and as will be explained hereinafter, a vertical sound propagation angle of 70 degrees is a practical limit for a loudspeaker constructed according to the present invention.

The auditorium also has side walls 18 and 20, and the side walls determine the horizontal sound pattern of the loudspeaker. For sound waves directed directly downwardly adjacent to end wall 12 from the loudspeaker 10, the listening area adjacent to the end wall 12 requires a horizontal sound propagation angle of 90 degrees. However, for sound waves reaching the base of the end wall 16 at the opposite end of the auditorium, a sound propagation angle of only 38 degrees is required. The sound propagation angles for planes parallel to the end walls 12 and 16 increase from 38 degrees to 90 degrees as the planes recede from the end wall 16 and approach the end wall 12. The required horizontal and vertical sound propagation angles are determined from conventional geometric formulae. The vertical propagation angle is given by the formula:

$$A_v = \tan^{-1}(H/L)$$

where "H" is the distance of the loudspeaker 10 above the floor 14 and "L" is the distance between the loudspeaker 10 and the end wall 16. The horizontal propagation angle is given by the formula:

$$A_h = 2\tan^{-1}(H/D)$$

where "D" is one-half of the distance between the side walls 18 and 20.

FIGS. 3 through 8 illustrate a loudspeaker 10 which is designed to produce a uniform sound pressure level across the floor 14 of the auditorium illustrated in FIGS. 1 and 2. The loudspeaker 10 consists of a driver 22, and a horn 24. The driver 22 is of conventional construction, and is a commercially available product, such as the model DHIA marketed by Electro-Voice, Incorporated of Buchanan, Mich. It operates over a frequency range of 500 to 20,000 Hz. and is provided with an output coupling mechanism with an output coupling flange 26 with a circular opening 28 suitable for connection to a horn. The driver 22 produces a uniform sound pressure per unit of area across the opening 28 of the coupling flange 26.

The horn 24 is formed by a shell 30 provided with a coupling flange 32 with a circular opening 34. The coupling flange 32 is secured to the flange 26 of the driver 22, and the opening 28 of coupling flange 26 of the driver 22 mates with the opening 34 of the coupling flange 32 of the horn 24 to acoustically couple the driver 22 to the horn 24. The shell 30 forms an internal sound propagating channel 36 which extends through the horn from the opening 34 to a mouth 38.

The sound propagating channel 36 extends through three acoustically communicating sections of the horn 24 , namely a throat 40, a coupling portion 42, and an outwardly flaring bell 44. The cross section of the sound channel 36 is transformed from a circular cross section at the entrance opening 34 to the cross section of a narrow slot 46 disposed on the interface 47 between the coupling portion 42 and the outwardly flaring bell 44. From the entrance opening 34, the cross section of the the channel 36 is gradually transformed or blended by smooth curves surfaces of the shell 30 throughout the throat 40 into a cross section at the interface between the throat 40 and the coupling portion 42 which is a small version of the slot 46, as illustrated in FIG. 7. In addition to transforming the shape of the channel 36, the throat 40 forms the throat of the horn 24 and provides proper loading for the driver 22.

In the coupling portion 42, the shell 30 is formed by walls 48, 50, 52 and 54 which confine the sound channel 36. Walls 50 and 54 are perpendicular to the vertical plane 56 of the horn, i.e. that plane which traverses the central axis and the major axis of the horn, and the walls 50 and 54 are substantially planar and flare outwardly from each other from the throat 40. In the coupling portion 42, the walls 50 and 54 have parallel opposed edges and the walls 48 and 52 extend between opposite ends of the walls 50 and 52, respectively, to form the portion of the sound channel through the coupling portion 42. The walls 48 and 52 are substantially flat adjacent to the wall 54 and curve outwardly from each other in the region adjacent to the wall 50, the wall 50 being wider than the wall 54. As a result, the cross section of the sound channel 36 is expanded vertically between the interface of the throat 40 and coupling section 42 to the interface between the coupling section 42 and the bell 44, but horizontally, the cross section is retained dimensionally constant between these interfaces. Further, the walls 48, 50, 52 and 54 shape the sound channel 36 at the interface between the coupling portion 42 with the bell 44 to that of the slot 46, a slot which is narrowest adjacent to the wall 54 and widest adjacent to the side wall 50. The coupling portion 42 expands the cross section of the sound channel 36 between the throat 40 and bell 42, but in each of these cross sections maintains the sound energy per unit of area constant. Since the area adjacent to the wall 50 is greater than the area adjacent to the wall 54 throughout the coupling portion 42, the sound energy adjacent to the wall 50 is also greater than the sound energy adjacent to the wall 52, and this relationship is true in the slot 46. Hence the throat 40 and coupling portion 42 form means for confining the sound transmitted from the driver 22 to the bell 44 of the horn to a narrow elongated band and means for progressively increasing the sound energy in the band from one end of the band to the other end of the band.

The walls 50 and 54 extend through the bell 44 of the horn 24, and remain planar in the bell 44. The walls 48 and 52 also extend through the bell 44 and these walls have panels 58 and 60, respectively, extending from the slot 46 and flaring outwardly at equal angles to the vertical plane 56. The panels 58 and 60 permit expansion of the sound waves from the slot 46 and control the horizontal angle of sound propagation. Hence, the panels 58 and 60 are positioned with respect to each other to provide the desired propagation angle.

The walls 48 and 52 also have flat second panels 62 and 64, respectively, which extend from the edges of the first panels 58 and 60 to the mouth 38 of the horn 24. The second panels 62 and 64 also diverge from the vertical plane 56 of the horn 24 at equal angles, but at much greater angles than the first panels 58 and 60 to facilitate uniform output throughout the frequency range of the loudspeaker. A strengthening rectangular rim 66 extends about the mouth 38, and the walls 48, 50, 52 and 54 terminate in the rim 66.

FIGS. 1 and 2 illustrate a typical application of a loudspeaker constructed according to the present invention for providing sound for the listening area defined by a quadrangular auditorium. Frequently encountered dimensions of the auditorium are height H, width 2H, and length 2.75H. With the loudspeaker 10 mounted centrally on one end wall 12 at a height H above the listening area, the necessary sound patterns can be calculated. To provide sound to the area immediately below the loudspeaker 10, the sound must be propagated from the loudspeaker through an angle of 90 degrees. To provide sound at the other end of the auditorium, sound must be propagated through an angle of 38 degrees. Further, the propagation angle must be correlated for each transverse section of the auditorium between the ends 12 and 16, and these angles will range between 38 degrees and 90 degrees as the section is selected between the end walls 16 and 12.

The sound channel 36 may be considered as having three separate sections, namely the throat 40, coupling section 42, and the bell 44, as best viewed in FIG. 5. In each section of the channel 36, the cross sectional area of the channel measured in planes perpendicular to the vertical plane 56 of the horn increases uniformly according to a mathematical function from the sound wave receiving end to the sound wave exoding end of the section. The areas of the cross sections of the throat 40 of the channel 36 increase from the plane of the coupling flange 32 to provide efficient loading of the driver 22. The areas of the cross sections of the coupling portion 42 of the channel 36 increase proportionally to the distance from the interface with throat 40. The areas of the cross sections of the bell 44 of the channel 36 are divided into two portions. The first portion extending from the slot 46 and confronting the first panels 58 and 60 increases roughly as the square of the distance from the slot 46. The second portion confronting the second panels 62 and 64 and extending between the first portion and the mouth 38 is a rapidly outwardly flaring bell.

The inventor takes advantage of the fact that acoustic power will be distributed equally across a wavefront area. Since sound waves passing through a portion of the slot 46 adjacent to the wall 54 project to that portion of the listening area nearest to the loudspeaker and sound waves passing through another portion of the slot 46 adjacent to the wall 50 project to that portion of the listening area furthest from the loudspeaker, the relative acoustic power to the two areas is the same as the relative sizes of the two portions of the slot 46. With the preferred construction of the horn set forth above, the vertical angle is 60 degrees, and this requires seven times the power to be propagated through the 10 degree segment of the slot 46 adjacent to the wall 50 as must be propagated through the 10 degree segment adjacent to the wall 54.

As presently understood, there are separate point sources with respect to the vertical expansion, that is expansion normal to the plane 56, and horizontal expansion of sound waves propagated through the horn 24. The slot 46 functions as a point source with respect to the surfaces of the horn 24 controlling dispersion normal to the plane 56, namely panels 58 and 60. Accordingly the distance between the walls 48 and 52 at the slot 46 must be sufficiently small to permit the slot to function as a point source with respect to horizontal dispersion, and accordingly this distance cannot exceed one wave-length at the highest frequency to be controlled by the horn. The vertical dispersion of sound waves propagated through the horn is controlled by the walls 50 and 54, which limit the expansion of sound waves in the vertical direction from an effective point source located at the acoustical throat which is located in the throat portion 40 of the horn 24.

The sound channel 36 must establish the configuration of the slot before the major axis of the wave front is longer than approximately two wavelengths at the highest frequency to be propagated by the horn 24. This requirement means that the throat 40 cannot exceed a few inches in length if the horn is to reproduce relatively high frequencies. Further, the length of coupling portion 42 of the horn must be sufficient to provide a slot 46 with a major axis sufficiently long compared to the longest wavelength to be propagated. The length of the major axis of slot 46 is determined by the same factors that determine the size of the mouth 46.

Figure 9:
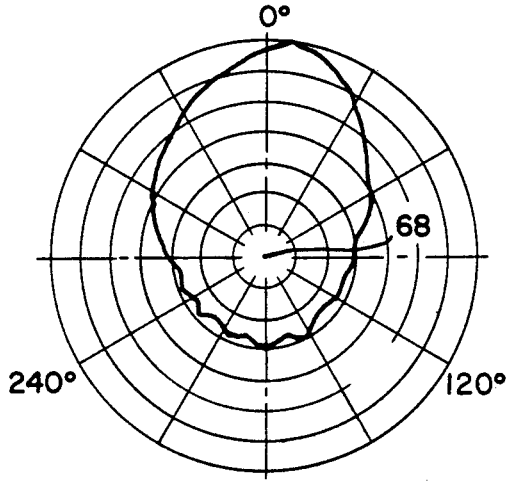
FIG. 9 is a vertical polar response graph at 2000 Hz for a loudspeaker constructed in accordance with a preferred construction of the loudspeaker of FIGS. 3 through 8.
Figure 8:
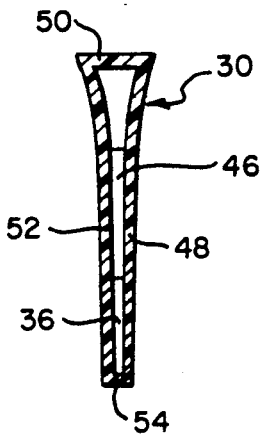
FIG. 8 is a sectional view taken along line 8—8 of FIG. 5.
Figure 10:
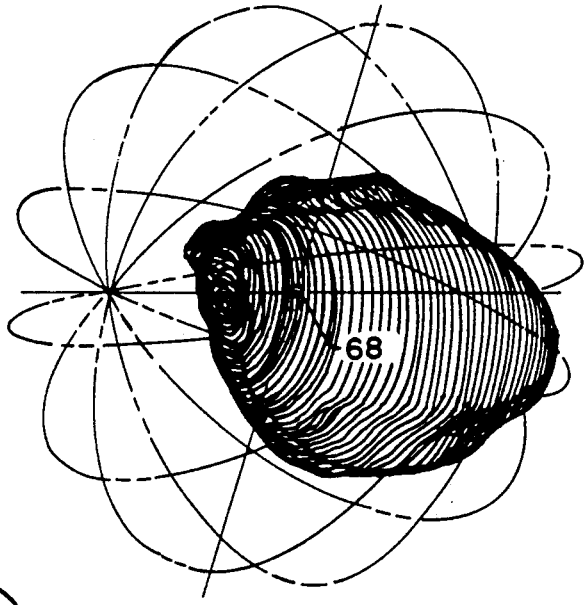
FIG. 10 is a graph showing a three dimensional response pattern at 2000 Hz for the loudspeaker with the polar response of FIG. 9.
Figure 11:
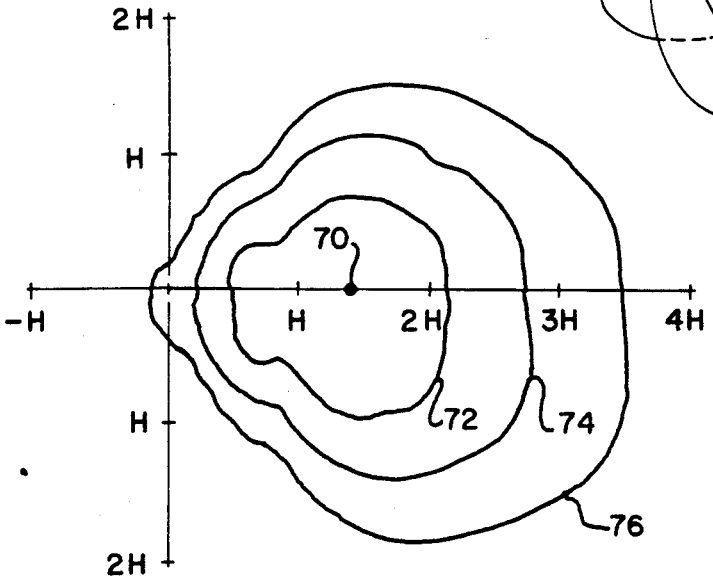
FIG. 11 is an isobar graph of the acoustical intensity at 2000 Hz projected onto the plane of the floor of an auditorium by the loudspeaker with the polar response of FIG. 9.

FIGS. 9 through 11 illustrate the acoustical response patterns at 2000 Hz. of a loudspeaker which is a construction of the foregoing embodiment. FIG. 9 illustrates the vertical polar response of the loudspeaker located at the point 68, that is the response in the plane 56. The response is highly directional in order to propagate significant energy to the far listening area, namely the area adjacent to the wall 6 of FIG. 1. FIG. 10 is a three dimensional depiction of the same loudspeaker at the same frequency with the loudspeaker located at point 68 within the envelope, the same location as in FIG. 9. FIG. 11 illustrates the acoustical response of the same loudspeaker at the same frequency mounted at the location of the loudspeaker 10 of FIG. 1 and measured on the floor 14. The loudspeaker is thus at height H above the floor 14, and is directed at the area 70 on the floor. Closed rings 72, 74 and 76 are illustrated surrounding the target area 70 and indicate regions surrounding the target area 70 of response greater than −3dB, −6dB and −9dB, respectively, distance being measured in units H equal to the height of the loudspeaker above the floor 14.

Figure 12:
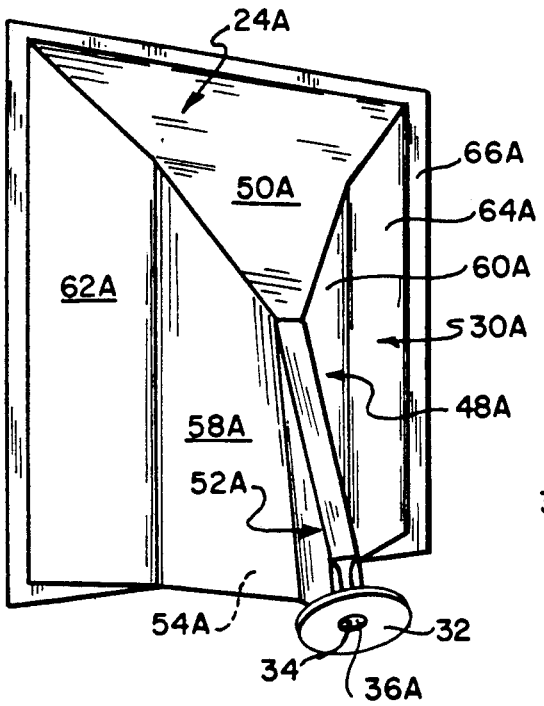
FIG. 12 is an isometric view of a loudspeaker horn which constitutes another embodiment of the present invention.
Figure 13:
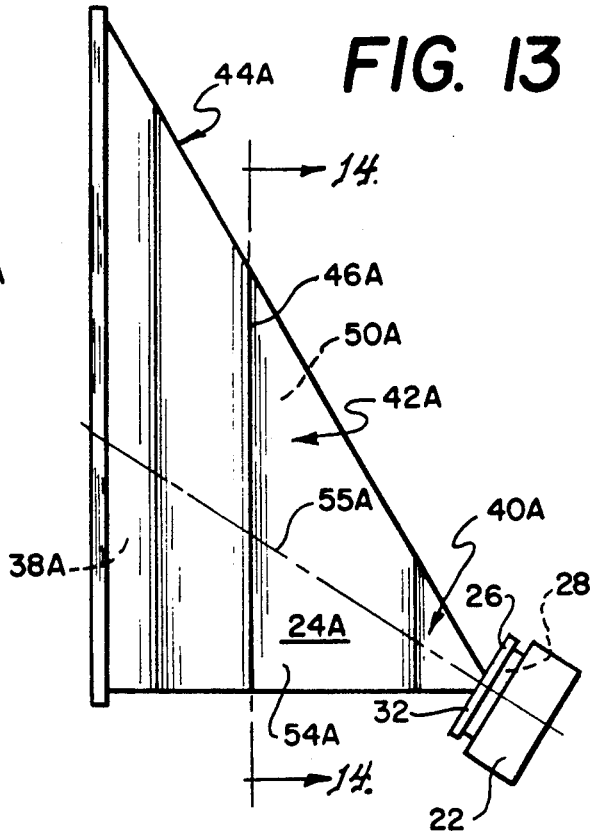
FIG. 13 is a side elevation view of the loudspeaker horn of FIG. 12 in combination with an acoustical driver.
Figure 14:
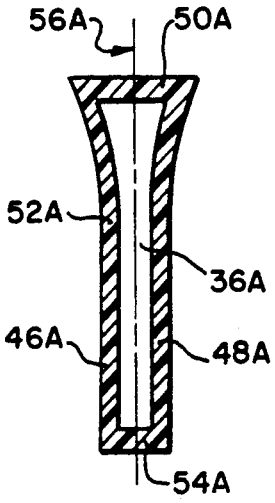
FIG. 14 is a sectional view of the horn taken along the line 14—14 of FIG. 13.

FIGS. 12, 13 and 14 illustrate another embodiment of the present invention. To the extent that elements are the same as in the prior embodiment, like reference numerals designate these elements. The loudspeaker 10A consists of a driver 22, and a horn 24A. The driver 22 is of conventional construction, and produces a uniform sound pressure per unit of area across the opening 28 of the coupling flange 26.

The horn 24A is formed by a shell 30A provided with a coupling flange 32 with a circular opening 34. The coupling flange 32 is secured to the flange 26 of the driver 22, and the opening 28 of coupling flange 26 of the driver 22 mates with the opening 34 of the coupling flange 32 of the horn 24A to acoustically couple the driver 22 to the horn 24A. The shell 30A forms an internal sound propagating channel 36A which extends through the horn from the opening 34 to a mouth 38A.

The sound propagating channel 36A extends through three acoustically communicating sections of the horn 24A, namely a throat 40A, a coupling portion 42A, and an outwardly flaring bell 44A. The cross section of the sound channel 36A is transformed from a circular cross section at the entrance opening 34 to the cross section of a narrow slot 46A disposed on the interface between the coupling portion 42A and the outwardly flaring bell 44A. In this embodiment of the invention, the slot 46A is perpendicular to the wall 54A and parallel to the mouth 38A. From the entrance opening 34, the cross section of the the channel 36A is gradually transformed or blended by smooth curves surfaces of the shell 30A throughout the throat 40A into a cross section at the interface between the throat 40A and the coupling portion 42A which is a small version of the slot 46A, as illustrated in FIG. 14.

In the coupling portion 42A, the shell 30A is formed by walls 48A, 50A, 52A and 54A which confine the sound channel 36A. Walls 50A and 54A are perpendicular to the vertical plane 56A of the horn, i.e. that plane which traverses the central axis 55A of the horn and is the major axis of the horn. The walls 50A and 54A are disposed at equal angles on opposite sides of the central axis 55A, and the walls 48A and 52A are likewise disposed at equal angles on opposite sides of the central axis 55A. The walls 50A and 54A are flat planar walls throughout the coupling portion and the throat 40A, and the wall 54A is disposed perpendicular to the mouth 38A.

The interface between the throat 40A and the coupling portion 42A is disposed parallel to the coupling flange 32, but the slot 46A which forms the interface between the coupling portion 42A and the bell 44A is disposed perpendicular to the wall 54A. Hence, sound waves propagated through coupling portion 42A of the channel 36A will first traverse the portion of the slot 46A adjacent to the wall 54A and thereafter the portion of the slot 46A adjacent to the wall 50A.

In the coupling portion 42A, the walls 50A and 54A have parallel opposed edges and the walls 48A and 52A extend between opposite ends of the walls 50A and 52A, respectively, to form the portion of the sound channel through the coupling portion 42A. The walls 48A and 52A are substantially flat adjacent to the wall 54A and curve outwardly from each other in the region adjacent to the wall 50A, the wall 50A being wider than the wall 54A. As a result, the cross section of the sound channel 36A is expanded vertically between the interface of the throat 40A and coupling section 42A to the interface between the coupling section 42A and the bell 44A, but horizontally, the cross section is retained dimensionally constant between these interfaces. Further, the walls 48A, 50A, 52A and 54A shape the sound channel 36A at the interface between the coupling portion 42A with the bell 44A to that of the slot 46A, a slot which is narrowest adjacent to the wall 54A and widest adjacent to the side wall 50A. The coupling portion 42A expands the area of the cross section of the sound channel 36A between the throat 40A and bell 44A, but in each of these cross sections maintains the sound energy per unit of area in that cross section constant. Since the area adjacent to the wall 50A is greater than the area adjacent to the wall 54A throughout the coupling portion 42A, the sound energy adjacent to the wall 50A is also greater than the sound energy adjacent to the wall 52A, and this relationship is true in the slot 46A. Hence the throat 40A and coupling portion 42A form means for confining the sound transmitted from the driver 22 to the bell 44A of the horn to a narrow elongated band and means for progressively increasing the sound energy in the band from one end of the band to the other end of the band.

The walls 50A and 54A extend through the bell 44A of the horn 24A, and remain planar in the bell 44A. The walls 48A and 52A also extend through the bell 44A and these walls have panels 58A and 60A, respectively, extending from the slot 46A and flaring outwardly at equal angles to the vertical plane 56A. The panels 58A and 60A are rectangular and parallel to the slot 46A. The panels 58A and 60A permit expansion of the sound waves from the slot 46A and control the horizontal angle of sound propagation. Hence, the panels 58A and 60A are positioned with respect to each other to provide the desired propagation angle.

The walls 48A and 52A also have flat second panels 62A and 64A, respectively, which extend from the edges of the first panels 58A and 60A to the mouth 38A of the horn 24A. The second panels 62A and 64A also diverge from the vertical plane 56A of the horn 24A at equal angles, but at much greater angles than the first panels 58A and 60A to facilitate uniform output throughout the frequency range of the loudspeaker. A strengthening rectangular rim 66A extends about the mouth 38A perpendicular to the wall 54A, and the walls 48A, 50A, 52A and 54A terminate in the rim 66A.

In the embodiment of FIGS. 12 through 14, the slot 46A forms a point source for horizontal expansion of sound waves propagated through the horn 24A, and the acoustical throat in the throat 40A of the horn forms an effective point source for vertical expansion of sound waves propagated through the horn 24A. The design has the advantages of providing a longer path for controlling the portion of the sound wave which passes through the wider portion of the slot 46A in the coupling portion 42A than the narrower portion of the sound wave, and provides a convenient configuration for directing the loudspeaker 10 toward the listening area.

Figure 15:
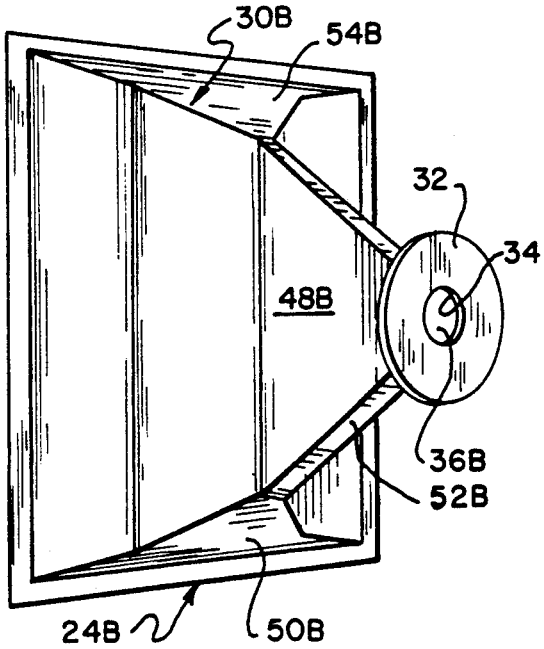
FIG. 15 is an isometric view of a loudspeaker horn which constitutes still another embodiment of the present invention.
Figure 16:
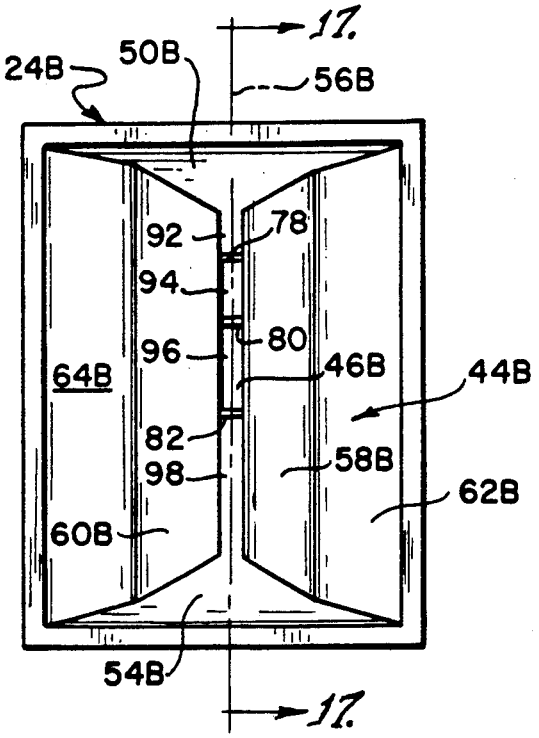
FIG. 16 is a front elevational view of the horn of FIG. 15.
Figure 17:
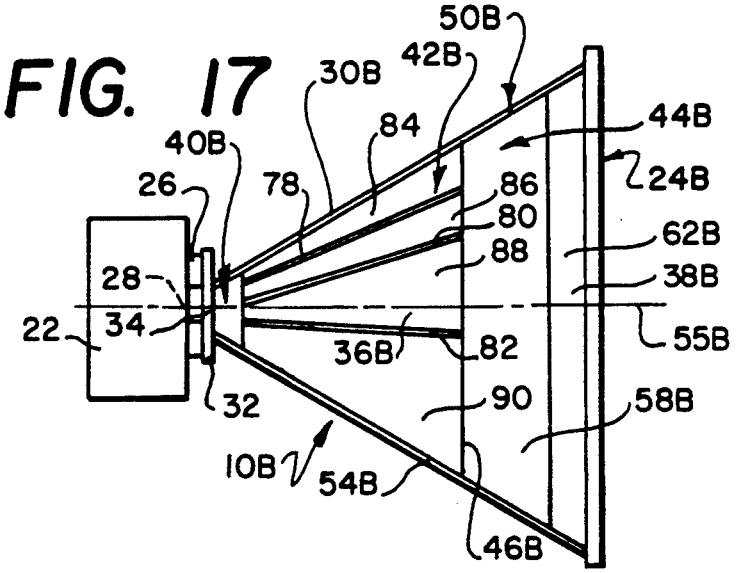
FIG. 17 is a sectional view taken along the line 17—17 in of FIG. 16 in combination with an acoustical driver.

FIGS. 15 through 17 illustrates a loudspeaker 10B which constitutes another embodiment of the present invention. To the extent that elements are the same as in the prior embodiment, like reference numerals designate these elements. The loudspeaker 10B consists of a driver 22, and a horn 24B. The driver 22 is of conventional construction, and produces a uniform sound pressure per unit of area across the opening 28 of the coupling flange 26.

The horn 24B is formed by a shell 30B provided with a coupling flange 32 with a circular opening 34. The coupling flange 32 is secured to the flange 26 of the driver 22, and the opening 28 of coupling flange 26 of the driver 22 mates with the opening 34 of the coupling flange 32 of the horn 24B to acoustically couple the driver 22 to the horn 24B. The shell 30B forms an internal sound propagating channel 36B which extends through the horn from the opening 34 to a mouth 38B.

The sound propagating channel 36B extends through three acoustically communicating sections of the horn 24B, namely a throat 40B, a coupling portion 42B, and an outwardly flaring bell 44B. The cross section of the sound channel 36B is transformed from a circular cross section at the entrance opening 34 to the cross section of a narrow slot 46B disposed on the interface between the coupling portion 42B and the outwardly flaring bell 44B. From the entrance opening 34, the cross section of the the channel 36B is gradually transformed or blended by smooth curved surfaces of the shell 30B throughout the throat 40B into a cross section at the interface between the throat 40B and the coupling portion 42B which is a small version of the slot 46B, as illustrated in FIG. 16.

In the coupling portion 42B, the shell 30B is formed by walls 48B, 50B, 52B and 54B which confine the sound channel 36B. Walls 50B and 54B are perpendicular to the vertical plane 56B of the horn, i.e. that plane which traverses the central axis 55B of the horn and is the major axis of the horn. The walls 50B and 54B are disposed at equal angles on opposite sides of the central axis 55B, and the walls 48B and 52B are likewise disposed at equal angles on opposite sides of the central axis 55B. The walls 50B and 54B are flat planar walls throughout the throat 40B, the coupling portion 42B and the bell 44B.

The interface between the throat 40B and the coupling portion 42B and the slot 46B are disposed parallel to the coupling flange 32. The walls 50B and 54B are flat throughout the entire horn 24B, and in the coupling portion 42B, the walls 50B and 54B have parallel opposed edges of equal width. The walls 48B and 52B extend parallel to each other between opposite ends of the walls 50B and 52B, respectively, to form the portion of the sound channel extending through the coupling portion 42B. As a result, the cross section of the sound channel 36B is expanded vertically between the interface of the throat 40B and coupling section 42B to the interface between the coupling section 42B and the bell 44B, but horizontally, the cross section is retained dimensionally constant between these interfaces. Further, the walls 48B, 50B, 52B and 54B shape the sound channel 36B at the slot 46B.

A plurality of flat vanes 78, 80 and 82 are mounted perpendicularly on the walls 48B and 52B, and the vanes extend from the interface between the throat 40B and coupling portion 42B to the slot 46B. The vanes 78, 80 and 82 divide the sound channel 36B at the interface between the throat 40B and coupling portion 42B into equal area portions, and since the acoustical energy per unit of area is the same at this interface, each of the paths between vanes receives the same acoustical energy from the throat 40B. In the particular construction illustrated, there are three vanes 78, 80 and 82, dividing the sound channel 38B into four sound paths 84, 86, 88 and 90, but more or fewer vanes can be used to divide the sound channel 38B into more or fewer sound paths.

The four sound paths 84, 86, 88 and 90 deliver equal sound energy to the slot 46B at the interface between the coupling portion 42B and the bell 44B, but the vanes are positioned to deliver this energy over different areas 92, 94, 96 and 98. The area 92 is the smallest area, and hence the greatest sound energy per unit of area passes through this portion of the slot 46B. The areas 94, 96 and 98 are each progressively larger, and accordingly the sound energy passing through these portions of the slot 46B is progressively lower. Hence the throat 40B and coupling portion 42B form another means for confining the sound transmitted from the driver 22 to the bell 44B of the horn to a narrow elongated band and means for progressively increasing the sound energy in the band from one end of the band to the other end of the band.

The walls 50B and 54B extend through the bell 44B of the horn 24B, and remain planar in the bell 44B. The walls 48B and 52B also extend through the bell 44B and these walls have panels 58B and 60A, respectively, extending from the slot 46B and flaring outwardly at equal angles to the vertical plane 56B. The panels 58B and 60B are rectangular and parallel to the slot 46B. The panels 58B and 60B permit expansion of the sound waves from the slot 46B and control the horizontal angle of sound propagation. Hence, the panels 58B and 60B are positioned with respect to each other to provide the desired propagation angle.

The walls 48B and 52B also have flat second panels 62A and 64A, respectively, which extend from the edges of the first panels 58B and 60B to the mouth 38B of the horn 24B. The second panels 62A and 64A also diverge from the vertical plane 56B of the horn 24B at equal angles, but at much greater angles than the first panels 58B and 60B to facilitate uniform output throughout the frequency range of the loudspeaker. A strengthening rectangular rim 66B extends about the mouth 38A perpendicular to the wall 54B, and the walls 48B, 50B, 52B and 54B terminate in the rim 66B. As in the embodiment of FIGS. 12 through 14, the slot 46B forms a point source for horizontal expansion of sound waves propagated through the horn 24B, and the acoustical throat in the throat 40B of the horn forms an effective point source for vertical expansion of sound waves propagated through the horn 24B.

In the foregoing embodiments, the horizontal propagation angle is controlled by the first panels of the bell, designated 58 and 60 in the first embodiment. Since these first panels are flat, the horizontal propagation angle is the same along the length of the slot 46. The sound waves propagated from the horn, however, can be made to more nearly match a rectangular listening area under the conditions illustrated in FIGS. 1 and 2, is the angle between the first panels is less adjacent to the portion of the slot propagating the maximum sound energy per unit of area. The embodiment of FIG. 18 accomplishes this objective and is an improvement on the first embodiment, but it is to understood that the teachings of this improvement are equally applicable to the other illustrated embodiments.

Figure 18:
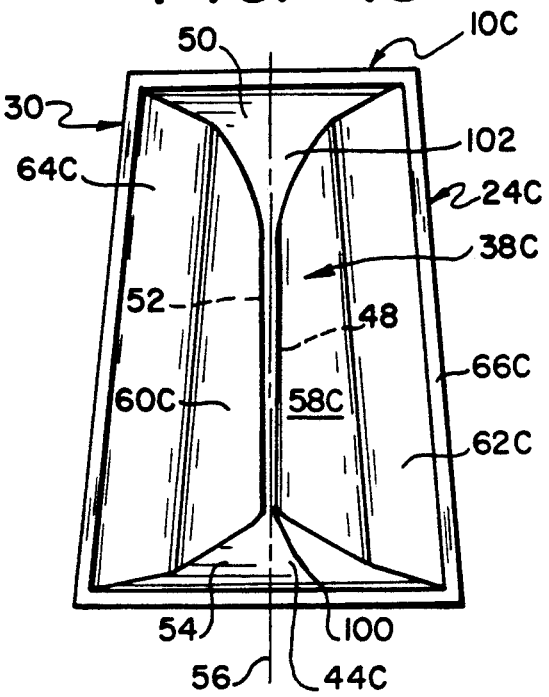
FIG. 18 is a front plan view of a modification of the loudspeaker of FIGS. 3 through 8.

FIG. 18 illustrates a loudspeaker 10C in which the driver, and the throat and coupling portions of the horn, designated 24C, are identical to those illustrated in FIGS. 3 through 8 of the first embodiment, and these elements are not further illustrated. The loudspeaker of FIG. 18, however differs from the first embodiment in the construction of the portion of the horn 24C referred to as the bell, designated 44C.

The horn 24C has a slot 46 through which sound waves are propagated to the bell 44C. The slot 46 is formed by walls 48 and 52 of a shell in the coupling portion 42 of the horn 24C, and the slot extends between walls 50 and 54 of the shell 30. The slot 46 is wider at one end 100 than at the other end 102, and accordingly the sound energy per unit of area at the end 100 exceeds that at the end 102. Further, the slot 46 progressively increases in area per unit of length from the end 102 to the end 100 thereof.

The horn 24C has a pair of first panels 58C and 60C which diverge at equal angles to the central plane 56 of the horn 24C, the panels 58C and 60C being on opposite sides of the slot 46. The first panels 58C and 60C extend from the slot 46 to a pair of second panels 62C and 64C which extend between the walls 50 and 54 to a supporting rim 66C. The first panels 58C and 60C and the second panels 62C and 64C are symmetrically disposed on opposite sides of the central plane 56 of the horn 24C.

When projecting sound downwardly and from one end upon a rectangular listening area, the horizontal deflection angle is much smaller for the distant end of the auditorium than it is for the adjacent end of the auditorium. The example given with reference to FIGS. 1 and 2 is 38 degrees for the remote end of the auditorium and 70 degrees for the adjacent end of the auditorium. In FIG. 18, the first panels 58C and 60C are shaped to provide a smallest angle to the central plane 56 at the end 100 and the largest angle to the central plane 56 at the end 102, and to progressively increase the angle to the central plane 56 for portions of the first panels 58C and 60C from the end 102 to the end 100. With this construction, the sound save propagated from one end and above a rectangular auditorium can produce a pattern on the floor of the auditorium substantially coinciding with the rectangular listening area.

The width of the first panels 58C and 60C measured from the slot 46 to the second panels 62C and 64C, respectively, is constant and the same as in the embodiment of FIGS. 3 through 8. The second panels 62C and 64C are rectangular flat members, and hence, the horn 24C is narrower at the end 100 of the slot than at the end 102 thereof resulting in a truncated horn mouth 38C and rim 66C. The width of the first panels should be as long as possible under the conditions in order to control the sound dispersion to as low a frequency as desired, and at least one-fourth wavelength at the lowest frequency to be controlled by the horn.

Those skilled in the art will recognize many other advantages of the present invention and devise many other uses and applications for the present invention in addition to those specifically disclosed herein. For example, a listening area can be considered as two contiguous listening areas, and the area can be served by two loudspeakers constructed according to the present invention mounted in back to back relationship and mounted centrally of the area. Further, such a listening area can be serviced by two horns constructed according to the present invention driven by a common driver, either by means of a bifurcated coupler or directly from the diaphragm of the driver. It is therefore intended that the scope of the present invention be not limited by the foregoing specification, but rather only by the appended claims.

The invention claimed is:

1. A loudspeaker for projecting sound over an area from a position located above the area comprising a driver having a sound output port, said driver producing a uniform distribution of sound energy across the output port throughout a frequency range of the loudspeaker, and a horn having walls defining a sound path extending between a sound inlet opening and a mouth, the sound inlet opening of the horn being acoustically coupled to the output port of the driver, said horn comprising a coupling portion extending from the inlet opening to an interface and an outwardly flaring portion extending from the interface to the mouth, portions of the walls of said horn forming a slot of a particular shape extending across the sound path at the interface between the coupling portion and the outwardly flaring portion of substantially smaller cross section than the mouth, said slot having a central axis of elongation and opposite ends on the axis of elongation, the walls of the horn providing a smooth transition between the inlet opening of the horn and the slot, and said horn including means for controlling the sound energy along the axis of elongation of the slot, the sound energy per unit of area being smallest at a first portion of the slot and greatest at a second portion of the slot, the sound energy increasing progressively between the first portion and second portion of the slot.

2. A loudspeaker for projecting sound over an area from a position located above the area according to claim 1, wherein said portions of the walls of the horn forming said slot comprise the means for controlling the sound energy along the axis of elongation of the slot, a width of the slot normal to the axis of elongation of the slot varying along a length of the slot, said slot having a minimum width adjacent to the first portion thereof and increasing from said first portion to a maximum width adjacent to the second portion thereof.

3. A loudspeaker for projecting sound over an area from a position located above the area according to claim 1, wherein the inlet opening of the horn is circular and the coupling portion of the horn has a first section with four flat walls extending from the slot and a second section extending between the first section and the inlet opening, the second section forming an acoustical transition for the sound path between the four flat walls and the circular inlet opening.

4. A loudspeaker for projecting sound over an area from a position located above the area according to claim 2, wherein the first portion of the slot is disposed at one end of the slot and the second portion of the slot is disposed at the other end of the slot, the length of the first and second portions measured on the axis of elongation of the slot being the same, and the area of the first portion being about one-sixth of the area of the second portion of the slot.

5. A loudspeaker for projecting sound over an area from a position located above the area according to claim 1, wherein the outwardly flaring portion of the horn has a first section extending from the slot and a second section extending from the first section to the mouth of the horn, the second section being a bell flaring outwardly from the first section with a flare rate significantly greater than the flare rate of any portion of the first section of the outwardly flaring portion of the horn.

6. A loudspeaker for projecting sound over an area from a position located above the area according to claim 5, wherein the mouth of the horn is rectangular.

7. A loudspeaker for projecting sound over an area from a position located above the area according to claim 5, wherein the mouth of the horn has two parallel edges normal to the central axis of the slot, one of said edges being disposed adjacent to the one end of the slot and being shorter than the other of said edges at the other end of the slot.

8. A loudspeaker for projecting sound over an area from a position located above the area according to claim 1, wherein the means for controlling the sound energy along the longitudinal axis of the slot comprises means dividing the sound channel between the throat of the horn and the slot thereof into a plurality of sound paths, each sound path having an inlet at the throat and an outlet at the slot, the sound outlets of the paths dividing the area of the slot in different proportions with respect to the sound paths than the sound inlets divide the area of the sound channel at the interface between the throat and the coupling portion with respect to the sound paths.

9. A loudspeaker for projecting sound over an area from a position located above the area comprising claim 1 wherein the means for controlling the sound energy along the longitudinal axis of the slot comprises a plurality of vanes extending between the throat and the slot, said vanes dividing the sound channel into a plurality of paths having inlets of equal area and outlets of different areas.

10. A loudspeaker for projecting sound over an area from a position located above the area according to claim 9, wherein the outlets of the sound paths are disposed in a row along the axis of the slot, the area of the outlets increasing progressively from one end of the row to the other end of the row.

11. A loudspeaker for projecting sound over an area from a position located above the area according to claim 2, wherein the sound channel is confined between two opposed walls, and the slot is perpendicular to one of the walls.

12. A loudspeaker for projecting sound over an area from a position located above the area comprising claim 1 wherein the outwardly flaring portion comprises a pair of panels symmetrically disposed on opposite sides of the slot, the portion of said panels confronting the other portion of the slot being at a smaller angle to each other than the angle between the portion of the panels confronting the one portion of the slot.

13. A loudspeaker for projecting sound over an area from a position located above the area according to claim 1, wherein the horn is provided with means for projecting a sound pattern from the slot wherein the sound projected from the one portion of the slot in which the sound energy per unit of area is lowest at a greater angle than an angle of projection from the second portion of the slot in which the sound energy per unit of area is greatest and progressively increasing the angle of projection from the second portion of the slot the first portion of the slot.

14. A horn for a loudspeaker for projecting sound over an area from a position located above the area comprising walls defining a sound path extending between a sound inlet opening and a mouth, the sound inlet opening of the horn being adapted to be acoustically coupled to a driver, said horn comprising a coupling portion extending from the inlet opening to an interface and an outwardly flaring portion extending from the interface to the mouth, portions of the walls of said horn forming a slot of a particular shape extending across the sound path at the interface between the coupling portion and the outwardly flaring portion of substantially smaller cross section than the mouth, said slot having a central axis of elongation and opposite ends on the axis of elongation, said walls of the horn providing a smooth transition between the inlet opening of the horn and the slot, and said horn including means for controlling the sound energy along the axis of elongation of the slot, the sound energy per unit of area being smallest at one end of the slot and progressively increasing to the other end of the slot.

15. A horn for a loudspeaker for projecting sound over an area from a position located above the area according to claim 14, wherein said portions of the walls of the horn forming said slot comprise the means for controlling the sound energy along the axis of elongation of the slot, said slot having a minimum width adjacent to said one end thereof and increasing from said one end to a maximum width adjacent to the other end thereof, the portions of the walls of said horn forming the slot defining a particular shape of the slot.

16. A horn for a loudspeaker for projecting sound over an area from a position located above the area according to claim 15, wherein the inlet orifice of the horn section is circular and the coupling portion of the horn has a first section with four flat walls extending from the slot and a second section extending between the first section and the inlet orifice, the second section forming an acoustical transition for the sound path between the four flat walls and the circular inlet orifice.

17. A horn for a loudspeaker for projecting sound over an area from a position located above the area according to claim 15, wherein an area of a first portion of the slot extending from one of the ends thereof a given distance is about one-sixth of the area of a second portion of the slot extending from the other end of the slot the said given distance.

18. A horn for a loudspeaker for projecting sound over an area from a position located above the area according to claim 15, wherein the outwardly flaring portion of the horn has a first section extending from the slot and a second section extending from the first section to the mouth of the horn, the second section being a ball flaring outwardly from the first section with a flare rate significantly greater than the flare rate of any portion of the first section of the outwardly flaring portion of the horn.

19. A horn for a loudspeaker for projecting sound over an area from a position located above the area according to claim 18, wherein the mouth of the bell of the horn is rectangular.

20. A horn for a loudspeaker for projecting sound over an area from a position located above the area according to claim 18, wherein the mouth of the horn has two parallel edges normal to the central axis of the slot, one of said edges being disposed adjacent to the one end of the slot and being shorter than the other of said edges at the other end of the slot.

* * * * *